United States Patent [19]

Dunne

[11] 4,405,034

[45] Sep. 20, 1983

[54] ROPE LADDER

[76] Inventor: James Dunne, 12518 S. Pawnee Rd., Palos Park, Ill. 60464

[21] Appl. No.: 334,130

[22] Filed: Dec. 24, 1981

[51] Int. Cl.[3] ..... E06C 1/56

[52] U.S. Cl. ..... 182/190; 182/100; 182/196

[58] Field of Search ..... 182/70, 76, 100, 189, 182/190, 196, 197, 198, 228

[56] References Cited

U.S. PATENT DOCUMENTS

| | | | |
|---|---|---|---|
| 132,073 | 10/1872 | Herold | 182/196 |
| 195,024 | 9/1877 | Knox | 182/190 |
| 256,207 | 4/1882 | Gibbs | 182/189 |
| 283,439 | 8/1883 | Torst | 182/70 |
| 541,120 | 6/1895 | Root | 182/70 |
| 584,376 | 6/1897 | Landenberger | 182/190 |
| 645,677 | 3/1900 | Wingert | 182/190 |
| 3,216,030 | 11/1965 | Garfield | 182/196 |
| 3,817,351 | 6/1974 | Mikkelson | 182/189 |
| 4,120,377 | 10/1978 | Charles | 182/196 |

FOREIGN PATENT DOCUMENTS

| | | | |
|---|---|---|---|
| 8393 | 4/1894 | Switzerland | 182/190 |
| 12575 | of 1902 | United Kingdom | 182/190 |

*Primary Examiner*—Reinaldo P. Machado
*Attorney, Agent, or Firm*—Basil E. Demeur

[57] ABSTRACT

A rope ladder having loops connected to a main piece of rope. The rope and loops are both made of three strand twisted rope with the loops connected to the main piece by interweaving the ends of the loops with the main piece of rope. The loops are connected to opposite sides of the main piece of rope to form steps which alternate on either side of the rope.

4 Claims, 5 Drawing Figures

ROPE LADDER

BACKGROUND OF THE INVENTION

This invention relates to ladders and more particularly, to flexible rope ladders.

There has recently developed a recognition of the need for a variety of safety equipment, especially adapted for home use. In short, there is a greater degree of public recognition of safety requirements for homeowners, apartment dwellers, and for commercial tenants in large multi-story commercial facilities. This is especially true in connection with fire safety equipment, in view of the excessive numbers of fires which occur yearly, and the numbers of people who are injured or killed in connection with home and apartment fires.

In this connection, a variety of escape devices have been manufactured and sold particularly to homeowners and apartment dwellers, for use in connection with fires. A typical piece of equipment, which is currently available, consists of a ladder formed by a pair of parallel chains having wood or metal slats interconnecting the parallel chains thereby to create a ladder which may be employed in the event of an emergency. The top of the ladder generally has a rigid metal framework which is intended to be hooked over the window sill, and the user then simply throwing the lower portion of the ladder out of the window until the same extends downwardly the full length thereof.

Another version of an escape ladder is known and presently commercially available, and is basically similar to the chain configuration described above, with the exception that rope is used for the long parallel sides of the ladder, with shorter lengths of rope being tied between the parallel lengths to form steps. Once again, either a framework is emloyed at the top end of the ladder, or each of the upper ends of the long parallel lengths of rope are provided with eyelets thereby intending that the upper end of the ladder be connected to an internal structure, with the balance of the ladder being displayed from the window to form an escape route.

Insofar as the chain ladder is concerned, one of the difficulties which has been observed is the fact that a chain ladder having rigid sections between the lengths of chain is not easily compacted and stored internally of the house. Even when totally folded, a chain ladder having rigid steps consumes a great deal of space, and often, the chains will interwind such that in an emergency, it is often necessary to unravel the lengths of chain so that the ladder may be fully extended. In addition, a ladder formed of chains and rigid cross members is extremely heavy, the weight being proportional to the size of the chain lengths, and the overall length of the ladder. Hence, small children or elderly persons may not be able to lift and manipulate the ladder in an emergency in order to deploy the same for emergency use. Furthermore, should the weight of the chain ladder and supporting framework be excessive, and the ladder connected to a wooden window sill, it is feasible that in older structures where the window sill is rotted or burned away, the ladder could tear loose injuring the users thereof during the emergency exit. Hence, there are problems associated with the chain-type rigid emergency ladders presently available.

Insofar as the flexible rope-type ladder is concerned, typically the rope pieces creating the steps are interconnected to the parallel lengths of rope by means of knots, and hence, the ladder is only as strong as the knots holding the cross pieces in position. In addition, typically such ladders are made of a nylon rope as opposed to hemp, with nylon having the tendency to curl and retain a curled posture when stored for long periods of time. Hence, when an emergency use does arise, nylon rope ladders tend to be difficult to unfold and do not always present an easily observable ladder configuration when in use. Finally, it is also known that when one attempts to use a rope ladder having rope pieces as cross members, it may well be difficult for the user to manipulate his legs from rope member to rope member, since the rope members have a tendency to buoy in the middle portion drawing the parallel side lengths together.

A variation of the flexible rope ladder employs two parallel lengths of rope as the side members, and a length of wooden pieces interposed between the parallel sides. The wooden steps generally have a hole drilled in each of the ends, such that the rope members may be inserted therethrough, and the step being held in position by means of a knot appropriately tied at predetermined distances along each of the two parallel lengths of rope such that the wooden slats are held in position. This type of ladder is more advantageous than the chain ladders since the rope will not have a tendency to intertwine and "hang up" on itself, while still providing the user with a rigid step to employ during an emergency exit. However, ladders of this type are similarly bulky to store, and again, if the rope portion of the ladder is made from a nylon-type or synthetic plastic-type material, when stored for long periods of time in a folded position, the synthetic resins have a tendency to retain a curled or looped configuration such that when the ladder is used in an emergency, the ladder will often not straighten out when deployed in its use position.

In accordance with the present invention, it is intended to create a flexible rope ladder which permits the user to have a secure footing when utilizing the ladder as an escape means, while at the same time permitting ease of compactness and storage during non-use. In addition, the rope ladder of the present invention is intended to be easily connected to any supporting structure internally of the house, and once deployed, to basically assume its intended vertical position down the length of the home, building, or other structure from which it is utilized. In addition, the mode of construction of the rope ladder of the present invention insures that each of the foot rests is securely retained to the main rope such that during use, there is a minimum of deformity in the ladder in order to facilitate the ability of the user to quickly manipulate himself down the rope ladder during an emergency exit.

In accordance with the above improvements, the flexible rope ladder of the present invention contemplates utilizing a main piece of three strand twisted rope, formed of either hemp or plastic, with a plurality of loops intertwined to the main rope, the plurality of loops being positioned along the length of the main rope thereby to form hand grasps and foot rests along the entire length of the main rope. In addition, the loops are intertwined to the main loop in left/right alternate configuration such that even should the rope ladder twist or turn during use, there is always one loop disposed in a 180° juxtaposition relative to the previous vertically disposed loop. Another advantage obtained by employing a flexible rope of the construction contemplated by the present invention is that the entire rope ladder may be made of less material, thereby being more easily compacted and stored, while at the same time, being easier to manipulate since there is less material involved in the entire construction of the ladder. Hence, the rope ladder of the present invention is more readily and easily usable by small children and elderly people then the rope ladders heretofore known.

OBJECTS AND ADVANTAGES

It is therefore the principal object of the present invention to provide a flexible rope ladder which is easily compacted and stored, but will nevertheless provide a sequential series of hand grasps and foot rests along the entire length of the ladder while eliminating some of the material heretofore used in flexible rope ladders thereby to make the same lighter weight, and easier to use.

In accordance with the foregoing object, it is a principal object of the present invention to provide a flexible rope ladder formed by a main piece of braided and stranded rope, and having a plurality of loops formed from a braided stranded material connected to the main piece of braided and stranded rope by interweaving the braided stranded material of each of the loops to the main piece of rope, each of the sequential loops being disposed in a 180° juxtaposition relative to the vertically adjacent loop located on the main piece of rope.

In accordance with the foregoing object, it is still another object of the present invention to provide a flexible rope ladder of the type described including a plurality of loops disposed along the length of the main piece of rope, each of the loops being disposed in a 180° juxtaposition relative to the previous adjacently located loop, each loop being connected to the main piece of rope by interweaving the ends thereof in an upward direction toward the top end of the rope, such that the point of connection is held in a 180° opposite direction from the stress point during use.

In connection with the foregoing objects, it is still a further object of the present invention to provide a flexible rope ladder of the type described wherein the top end of the main piece of rope forming the center of the rope ladder includes a closed loop end such that the top end of the flexible rope ladder may be interconnected with any solid upstanding object quickly and efficiently.

Further features of the invention pertain to the particular arrangement of the elements and parts whereby the above-outlined and additional operating features thereof are attained.

The invention, both as to its organization and method of operation, together with further objects and advantages thereof, will best be understood by reference to the following specification, taken in connection with the accompanying drawings.

SUMMARY OF THE INVENTION

In summary, the present invention provides a flexible rope ladder which is formed from a single main piece of rope, and having a plurality of loop members interwoven and braided into the main piece of rope, such that when completed, the entire rope ladder is of unitary construction. The upper end of the rope ladder includes a top end which is formed into a closed loop and spliced downwardly into the main rope, such that the splicing is in a direction 180° away from the direction of the force of stress during use. Similarly, each of the loop members is interwoven into the main length of rope, the interweaving being constructed and designed to be 180° against the direction of the force during use, thereby to increase the strength of the entire rope ladder during use. In connection with the above point, it will be noted from FIG. 1 of the drawings that the splicing of each of the loop members occurs in an upward direction toward the top end of the ladder, such that when the user is employing the rope ladder, and positions his weight into each of the loops, the direction of the force is in a downward direction, or 180° opposed from the direction of interconnection. In addition, each of the loops alternates down the length of the main rope 180° relative to the next vertically adjacent loop, in order to provide a convenient and easy to use ladder configuration while at the same time, eliminating the need for any cross members, as well as parallel lengths of main ropes in order to create a ladder construction.

DETAILED DESCRIPTION OF DRAWINGS

Figure 1:
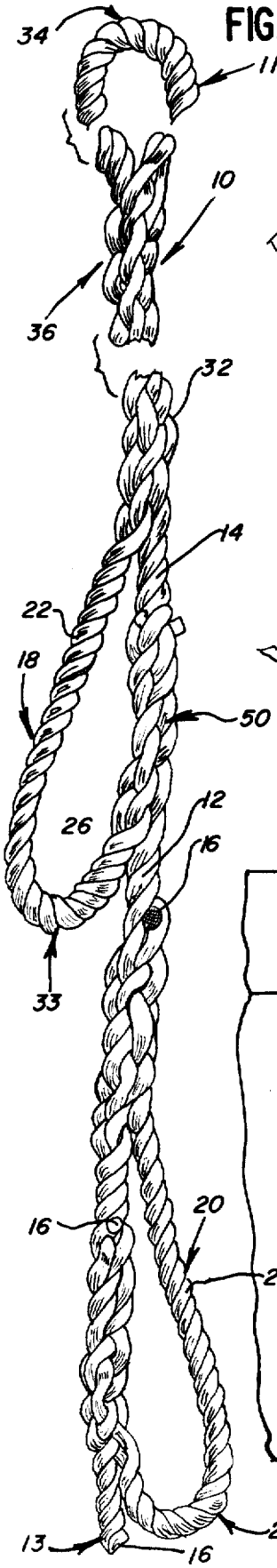
FIG. 1 is a side elevational view, partly fragmentary, showing the construction of the flexible rope ladder with the present invention.

Turning now to FIG. 1 of the drawings, there is shown the rope ladder 10 of the present invention. The rope ladder 10 is shown to be formed from a main rope piece 12, which appears similar to conventional three strand twisted rope, and includes a top end 11 and a bottom end 13. The main rope piece 12 is made from individual strands 14 which themselves are made from individual fibers or threads. The strands 14 are shown to be twisted in a conventional configuration in order to form the entire main rope piece 12. The cut ends of the strands 16 are treated, such as by heat, or wrapped in a manner known in the art in order to prevent each of the strands 14 from unraveling.

There is also shown individual shorter pieces of rope 18 and 20 which are formed in a similar twisting operation from individual strands 22 and 24 respectively. These shorter pieces of rope 18 and 20 form the loops 26 and 28 which are used to form the hand grasps and foot steps of the rope ladder 10 in the manner to be described hereinafter. The ladder is created during the rope manufacturing process at the time when the strands 14 are braided to form the rope in the manner discribed herein. The strands 22 and 24 have ends which are braided and interwoven into the strands 14 of the main rope piece 12 as generally illustrated in FIG. 1. In each instance, the shorter piece of rope 18 and 20 forming the loop 26 and 28 respectively, is interwoven into the strand 14 for a length of approximately 4 to 5 inches in the preferred embodiment, and is woven in the direction toward the top end 11 of the main rope piece 12. Indeed, it will be observed that each of the ends of the short piece of rope 18 and 20 respectively, is interwoven with the strand 14 upwardly in the direction of the top end 11 of the main rope piece 12. As indicated, in the preferred embodiment, the interweaving occurs for a length of approximately 4 to 6 inches, which provides each of the loops 26 and 28 with sufficient strength such that they will not be pulled or become unbraided from the main rope piece 12 when supporting the weight of an average person thereon. It will also be appreciated that by splicing the short pieces of rope 18 and 20 in an upward direction toward the top end 11 of the main rope piece 12, the interweaving occurs in a direction 180° opposed from the direction of the force applied to the loop 26 and 28 when the user inserts his or her foot therein to descend or ascend the rope ladder. This construction will therefore provide the maximum degree of safety and support for the user during use.

It will be observed that loop 26 is shown to be interwoven with the main rope piece 12 in the area designated by the numeral 30. The upper end of the loop is spliced into the main rope piece 12 at the area designated with the numeral 32. Both of the areas 30 and 32 respectively are above the bottommost portion 33 of the loop 26 which has assumed an oval shape when the rope ladder 10 is hung in its vertical usable posture. This construction results from the fact that both of the ends of the short pieces of rope 18 and 20 when forming the loops 26 and 28 respectively are spliced in an upward direction toward the top end 11 of the main rope piece 12.

It will be observed that the upper end of the rope ladder 10 as shown in FIG. 1, has a closed top loop 34. This is formed by taking the end of the main rope piece 12 and folding it back over itself, and then splicing the individual strand 14 with the end of the strands 14 in the area represented by the numeral 36. This construction creates a closed top loop which can be looped over any rigid upright post or other object and can serve as a firm anchoring point for the top of the rope ladder 10. In addition, this type of a closed top loop permits the rope ladder 10 to be attached to a ring or other mooring fixture as is typically encountered in nautical environments (see FIG. 5).

It will also be noted in the preferred embodiment of the invention that the vertically adjacent loops 26 and 28 extending along the length of the ladder 10 are connected to opposite sides of the main rope piece 12 in alternating fashion. In short, each succeeding loop 26 and 28 relative to the previously adjoining loop 26 or 28, is positioned 180° relative to the plane of preceding the loop. This construction therefore forms alternate steps or grasping loops on either side of the main rope piece 12 whereby the user of the rope will straddle the main rope piece placing a foot on each side of the main rope piece and a hand on each side of the main rope piece during the ascent or descent. Thus, the user may straddle the rope and have his weight substantially centrally aligned along the length of the rope thereby to lend greater stability to the rope, while permitting the user to essentially ascend or descend the rope in the same manner as a conventional ladder.

Figure 2:
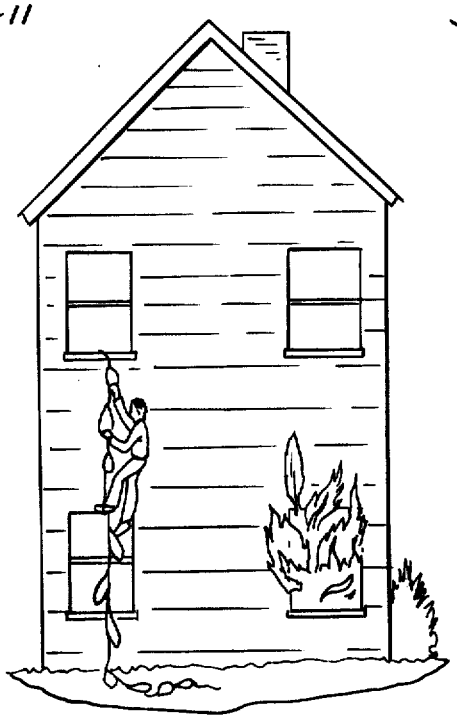
FIGS. 2 through 5 are perspective views showing illustrative examples of application in which the flexible rope of the present invention may be utilized, and the manner in which the user would manipulate himself along the length of the flexible ladder.

Numerous applications are contemplated for a rope ladder 10 of the construction shown in the present invention. For example, an emergency escape rope ladder, as shown in FIG. 2, is a primary user for a flexible rope ladder of the type disclosed herein. The closed top loop 34 may be looped over a bedpost, or any other upright solidly affixed to the interior of the premises, and the rope ladder 10 simply deployed from window to permit the user to descend thereon. As indicated previously, the advantage of a flexible rope ladder of the construction set forth herein permits children and elderly people to easily manipulate the rope ladder during an emergency, while at the same time providing a highly stable structure to descend. In addition, it will be observed that the elimination of a rigid structure such as wooden steps as used in connection with other forms of chain or rope ladders substantially minimizes the possible injury to the user during the procedure of extending the ladder out of a window or other opening, and provides a structure which is less bulky to handle.

Figure 3:
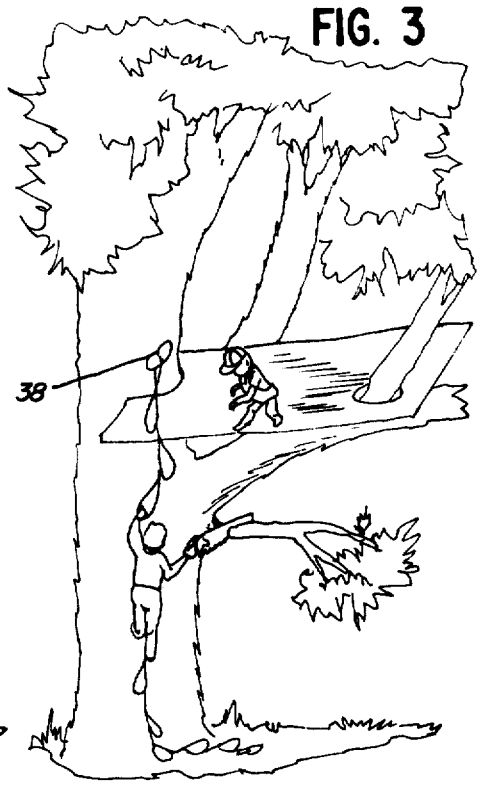

In FIG. 3, an alternate application of the rope ladder 10 of the present invention is shown, wherein the closed top loop 34 may be placed over an outstanding tree branch 38 which forms an anchor point for the top of the rope. As shown in FIG. 3, in this application the rope ladder 10 may be used for play purposes such as gaining access to a treehouse or the like, or for work purposes as also generally illustrated in FIG. 3. It has been found that the rope ladder 10 will in fact work quite well for any job functions wherein the user need only use one hand in order to permit the user to grasp one of the loops 26 to anchor and steady himself when on the rope ladder 10.

Figure 4:
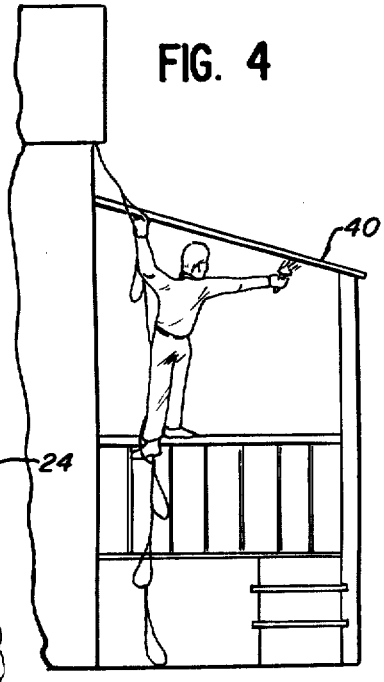

FIG. 4 illustrates still another exemplary use of the rope ladder 10 and shows the ladder being used for work purposes. Once again, where the user need only employ one hand to perform a particular job function, such that the other hand may be used for stabilization purposes, it has been found that the rope ladder 10 of the present invention may be conveniently used for various job functions.

Figure 5:
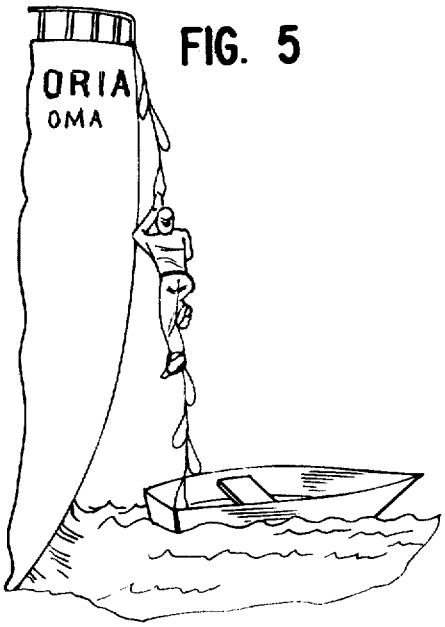

FIG. 5 illustrates a nautical use for a rope ladder of the present invention, and it is intended that a rope ladder 10 of the present invention may easily replace debarkation nets of the type typically known to the public. Once again, the advantage of the rope ladder 10 of the present invention is that the same is less bulky than the typical debarkation nets, and hence is easier for the user to manipulate when securing the same to a mooring point, and placing the rope ladder in position for use. In addition, it will be appreciated that a rope ladder 10 of the present invention may also be employed on sail boats, or other pleasure boats which require, in many instances, the need for the user to ascend to a certain point above the deck of a boat, in order to perform a job function.

In terms of materials, it is contemplated that the rope ladder 10 of the present invention be formed from a material which is lightweight but yet quite strong. Typical materials from which the rope may be made are as diversified as manila, sisal, nylon, dacron, or a variety of polyethylene. The advantages of ropes from synthetic resin fibers is that they are generally stronger, impervious to moisture, and in the case of polyethylene, will float indefinitely on water. It will also be apparent that the only requirement for the material selection is that the material permit the twisting of the strands into the fibers necessary to create the rope construction during the manufacturing process.

Thus, it will be apparent from the above description that there has been provided a rope ladder which is compact while yet strong during use, all in accordance with the objects, aims and advantages as set forth above. Accordingly, it is intended to cover in the appended claims all such alternatives, modifications, and variations as may be within the true spirit and scope of the present invention.

I claim:

1. A rope ladder comprising, a main rope piece formed of a twisted, stranded fibrous material, said main rope piece including a top end and a bottom end, a plurality of short rope pieces formed from a twisted and stranded fibrous material, each of said short rope pieces including opposed ends, each of said short rope pieces including one end securely connected to said main rope piece by interweaving the braided and stranded fibrous material forming said short rope piece with the twisted and stranded fibrous material forming said main rope piece, said splicing facing the direction of the top end of said main rope piece, and the opposed end of said short rope piece similarly being securely connected to the main rope piece by splicing the opposed end of the twisted and stranded fibrous material forming said short rope piece with the twisted and stranded material forming said main rope piece, said splicing similarly extending in an upward direction toward the top end of said main rope piece, each of the plurality of short rope pieces thereby creating a plurality of loops along the length of said main rope piece, and each of said plurality of loops being sequentially positioned on opposed sides of said main rope piece in alternating fashion along the length thereof, each succeeding loop secured to said main rope piece being 180° out of the plane of the immediately previous vertically positioned loop whereby said loops are positioned in alternating side to side relationship along the entire length of said main rope piece.

2. The rope ladder as set forth in claim 1 above, wherein the top end of said main rope piece further includes a closed top loop formed at the end thereof, said closed top loop being formed by folding the main rope piece back over itself and interweaving the twisted and stranded end of the main rope piece with the braided and stranded portions of the main piece thereby to create a closed loop at the top end thereof.

3. The rope ladder as set forth in claim 1 above, wherein said main rope piece and said plurality of loops are each formed of a synthetic plastic resin material.

4. The rope ladder as set forth in claim 3 above, wherein the main rope piece and the plurality of loops are each made of nylon strands.

* * * * *